US006797685B2

(12) United States Patent
Zhu et al.

(10) Patent No.: US 6,797,685 B2
(45) Date of Patent: Sep. 28, 2004

(54) LIQUID LAUNDRY DETERGENT WITH EMULSION LAYER

(75) Inventors: Yun-Peng Zhu, Fort Lee, NJ (US); Feng-Lung Gordon Hsu, Tenafly, NJ (US)

(73) Assignee: Unilever Home & Personal Care USA, division of Conopco, Inc., Greenwich, CT (US)

( * ) Notice: Subject to any disclaimer, the term of this patent is extended or adjusted under 35 U.S.C. 154(b) by 144 days.

(21) Appl. No.: 10/134,348

(22) Filed: Apr. 26, 2002

(65) Prior Publication Data

US 2003/0203830 A1 Oct. 30, 2003

(51) Int. Cl.[7] ..... C11D 17/00; C11D 3/43

(52) U.S. Cl. ..... 510/417; 510/424; 510/506; 510/437; 510/365

(58) Field of Search ..... 510/417, 424, 510/506, 437, 434, 365, 505, 238, 470, 433

(56) References Cited

U.S. PATENT DOCUMENTS

| | | | | | |
|---|---|---|---|---|---|
| 3,533,955 | A | | 10/1970 | Pader et al. | 252/153 |
| 3,718,609 | A | | 2/1973 | Weimer | 252/545 |
| 3,810,478 | A | | 5/1974 | Olson, Jr. et al. | 132/7 |
| 4,348,292 | A | | 9/1982 | Ginn | 252/90 |
| 4,533,487 | A | * | 8/1985 | Jones | 510/405 |
| 4,749,516 | A | | 6/1988 | Brusky | 252/546 |
| 4,793,942 | A | * | 12/1988 | Lokkesmoe et al. | 510/222 |
| 5,165,917 | A | | 11/1992 | Zabotto et al. | 424/70 |
| 5,883,065 | A | | 3/1999 | Swift, II et al. | 510/321 |
| 5,929,019 | A | | 7/1999 | Puvvada et al. | 510/406 |
| 6,019,991 | A | * | 2/2000 | Tanaka et al. | 424/401 |
| 6,180,587 | B1 | | 1/2001 | Fuller et al. | 510/417 |
| 6,232,282 | B1 | | 5/2001 | Kvietok et al. | 510/357 |
| 6,429,177 | B1 | * | 8/2002 | Williams et al. | 510/130 |
| 6,521,584 | B1 | * | 2/2003 | Soldanski et al. | 510/417 |
| 2001/0006088 | A1 | | 7/2001 | Lyle | 156/145 |

FOREIGN PATENT DOCUMENTS

| | | |
|---|---|---|
| CA | 951 213 | 7/1974 |
| EP | 116 422 | 8/1984 |
| EP | 175 485 | 3/1986 |
| EP | 368 622 | 5/1990 |
| FR | 2 252 403 | 6/1975 |
| GB | 1 247 189 | 9/1971 |
| WO | 99/47634 | 9/1999 |
| WO | 99/47635 | 9/1999 |
| WO | 01/21751 | 3/2001 |
| WO | 01/98450 | 12/2001 |
| WO | 02/02731 | 1/2002 |
| WO | 02/04589 | 1/2002 |

OTHER PUBLICATIONS

Co–pending Application: Applicant: Lyle; Ser. No. 09/737,355; Filed: Dec. 15, 2000.

Co–pending Application: Applicant: Hsu et al.; Ser. No. 09/941,219; Filed: Aug. 28, 2001.

Co–pending Application: Applicant: Hsu et al.; Ser. No. 10/020,462; Filed: Dec. 14, 2001.

Co–pending Application: Applicant: Hsu et al.; Ser. No. 10/017,203; Filed: Dec. 14, 2001.

Co–pending Application: Applicant: Hsu et al.; Ser. No. 10/017,025; Filed: Dec. 14, 2001.

EP Search Report in an EP application EP 03 07 5883, Jul. 30, 2003.

Derwent Abstract for FR 2 252 403 published Jul. 25, 1975.

* cited by examiner

*Primary Examiner*—Gregory Webb
(74) *Attorney, Agent, or Firm*—Rimma Mitelman

(57) ABSTRACT

An aqueous liquid laundry detergent composition comprising a detergent surfactant (including anionic), an emulsifier with an HLB value below about 8.5; an oil; and an electrolyte in an amount to provide ionic strength indicator of from about 0.55 to about 6.7. The composition separates, upon standing for at most 24 hours at ambient temperature, into at least two layers, one of which is an emulsion with a continuous aqueous phase. The second layer is preferably a transparent composition.

15 Claims, No Drawings

LIQUID LAUNDRY DETERGENT WITH EMULSION LAYER

FIELD OF THE INVENTION

The present invention relates to aqueous liquid laundry detergent compositions comprising an emulsion layer.

BACKGROUND OF THE INVENTION

Liquid laundry detergents are popular with the consumers. It is sometimes desirable to separate various ingredients of the liquid detergent composition. It is also desirable to increase the visual appeal of the detergent package and to provide a unique appearance to be associated by consumers with a particular product. In addition, it is desirable to provide a visual signal to a consumer of the presence of special (e.g., benefit) ingredient in the composition.

EP 116422, EP 175485, GB 1247189, WO 99/47635, Ginn (U.S. Pat. No. 4,348,292), Fuller et al. (U.S. Pat. No. 6,180,587), Swift et al. (U.S. Pat. No. 5,883,065) disclose dual layer liquid cleaning compositions in a bottle or a water insoluble package. The layers are both aqueous and are achieved by employing an electrolyte, which when added to an aqueous surfactant solution, forces the separation of the surfactant from the aqueous phase. The phenomenon of separating an organic component from an aqueous layer, by the addition of a salt (electrolyte) is known as "salting out." The salt increases the ionic character of water and drives the organic, less polar, component away.

Personal cleansing compositions (body wash or shampoo) containing oil are disclosed by e.g. Puvvada et al. (U.S. Pat. No. 5,929,019), Pader, et al., (U.S. Pat. No. 3,533,955), CA951213, Weimer (U.S. Pat. No. 3,718,609), Zabotto et al. (U.S. Pat. No. 5,165,917), and Lyle (U.S. Ser. No. 20010006088). Multiphase aqueous/non-aqueous home care cleaning compositions are disclosed in e.g. WO01/98450, WO02/02731, WO01/21751, WO99/47634, and WO02/04589. Such compositions are shaken before use, to create a temporary emulsion for uniform dispensing and use. Olson et al. (U.S. Pat. No. 3,810,478) discloses a two-phased shampoo composition containing a lower clear polar phase and an upper lotion-like emulsion phase which may be an oil-in-water emulsion.

It is desirable to incorporate oil into laundry detergent compositions for several reasons. Among functional reasons is the ability of the oil to enhance removal of oily stains from fabrics. In addition, oil absorbed onto fabrics provides some degree of softening and anti-wrinkle benefits. Among aesthetic reasons is an increased appeal of a liquid detergent product and to provide a visual signal to a consumer. Unfortunately, if oil is just incorporated into existing laundry detergent compositions, even if the composition is shaken to create a temporary emulsion, the oil layer sticks to the walls of a container during use. This is especially problematic in the field of laundry detergents because containers tend to be larger than the personal care containers and thus the amount of oil on the walls may be significantly detracting from the function and appearance of the product. Thus, it is desirable for functional and aesthetic reasons to provide liquid laundry detergent with an emulsion (milky, lotion-like) layer, wherein oil is present in the form of an emulsion layer with continuous aqueous phase.

SUMMARY OF THE INVENTION

The present invention includes an aqueous liquid laundry detergent composition comprising a detergent surfactant (including anionic), an emulsifier with an HLB value below about 8.5; an oil; and an electrolyte in an amount to provide ionic strength indicator of from about 0.55 to about 6.7. The composition separates, upon standing for at most 24 hours at ambient temperature, into at least two layers, one of which is an emulsion with a continuous aqueous phase. The second layer is preferably a transparent composition.

Surprisingly, the emulsion layer that is created has a continuous aqueous phase (i.e. oil-in-water or water-in-oil-in water emulsion), even though the emulsifier that is employed has low HLB typical of water-in-oil emulsifiers, so water-in-oil emulsion would be expected.

The presence of an emulsion layer (which appears as a milky layer) may convey a visual signal of a milder product which may be especially suitable for fine wash or pretreatment laundry product. In addition, the emulsion layer may include oil-soluble or water-insoluble functional ingredients, to preserve the transparency of the second layer, or may include, in the emulsion's oil phase, water-sensitive ingredients which need to be protected from water.

DETAILED DESCRIPTION OF THE INVENTION

Except in the operating and comparative examples, or where otherwise explicitly indicated, all numbers in this description indicating amounts of material or conditions of reaction, physical properties of materials and/or use are to be understood as modified by the word "about." All amounts are by weight of the liquid detergent composition, unless otherwise specified.

It should be noted that in specifying any range of concentration, any particular upper concentration can be associated with any particular lower concentration.

For the avoidance of doubt the word "comprising" is intended to mean "including" but not necessarily "consisting of" or "composed of." In other words, the listed steps or options need not be exhaustive.

"Liquid" as used herein means that a continuous phase or predominant part of the composition is liquid and that a composition is flowable at 20° C. (i.e., suspended solids may be included).

Detergent Surfactant

The compositions of the invention contain one or more surface active agents selected from the group consisting of anionic, nonionic, cationic, amphoteric and zwitterionic surfactants or mixtures thereof. The preferred surfactant detergents for use in the present invention are mixtures of anionic and nonionic surfactants although it is to be understood that anionic surfactant may be used alone or in combination with any other surfactant or surfactants. Detergent surfactants are typically oil-in-water emulsifiers having an HLB above 8, typically 12 and above. Detergent surfactants are included in the present invention for both the detergency and to create an emulsion with a continuous aqueous phase.

Anionic Surfactant Detergents

Anionic surface active agents which may be used in the present invention are those surface active compounds which contain a long chain hydrocarbon hydrophobic group in their molecular structure and a hydrophilic group, i.e. water solubilizing group such as carboxylate, sulfonate or sulfate group or their corresponding acid form. The anionic surface active agents include the alkali metal (e.g. sodium and potassium) water soluble higher alkyl aryl sulfonates, alkyl sulfonates, alkyl sulfates and the alkyl poly ether sulfates. They may also include fatty acid or fatty acid soaps. One of the preferred groups of anionic surface active agents are the alkali metal, ammonium or alkanolamine salts of higher alkyl aryl sulfonates and alkali metal, ammonium or alkanolamine salts of higher alkyl sulfates. Preferred higher alkyl sulfates are those in which the alkyl groups contain 8 to 26 carbon atoms, preferably 12 to 22 carbon atoms and more preferably 14 to 18 carbon atoms. The alkyl group in the alkyl aryl sulfonate preferably contains 8 to 16 carbon atoms and more preferably 10 to 15 carbon atoms. A particularly preferred alkyl aryl sulfonate is the sodium, potassium or ethanolamine $C_{10}$ to $C_{16}$ benzene sulfonate, e.g. sodium linear dodecyl benzene sulfonate. The primary and secondary alkyl sulfates can be made by reacting long chain alpha-olefins with sulfites or bisulfites, e.g. sodium bisulfite. The alkyl sulfonates can also be made by reacting long chain normal paraffin hydrocarbons with sulfur dioxide and oxygen as describe in U.S. Pat. Nos. 2,503,280, 2,507,088, 3,372,188 and 3,260,741 to obtain normal or secondary higher alkyl sulfates suitable for use as surfactant detergents.

The alkyl substituent is preferably linear, i.e. normal alkyl, however, branched chain alkyl sulfonates can be employed, although they are not as good with respect to biodegradability. The alkane, i.e. alkyl, substituent may be terminally sulfonated or may be joined, for example, to the 2-carbon atom of the chain, i.e. may be a secondary sulfonate. It is understood in the art that the substituent may be joined to any carbon on the alkyl chain. The higher alkyl sulfonates can be used as the alkali metal salts, such as sodium and potassium. The preferred salts are the sodium salts. The preferred alkyl sulfonates are the $C_{10}$ to $C_{18}$ primary normal alkyl sodium and potassium sulfonates, with the $C_{10}$ to $C_{15}$ primary normal alkyl sulfonate salt being more preferred.

Mixtures of higher alkyl benzene sulfonates and higher alkyl sulfates can be used as well as mixtures of higher alkyl benzene sulfonates and higher alkyl polyether sulfates. Also normal alkyl and branched chain alkyl sulfates (e.g., primary alkyl sulfates) may be used as the anionic component.

The higher alkyl polyethoxy sulfates used in accordance with the present invention can be normal or branched chain alkyl and contain lower alkoxy groups which can contain two or three carbon atoms. The normal higher alkyl polyether sulfates are preferred in that they have a higher degree of biodegradability than the branched chain alkyl and the lower poly alkoxy groups are preferably ethoxy groups.

The preferred higher alkyl polyethoxy sulfates used in accordance with the present invention are represented by the formula:

$$R^1—O(CH_2CH_2O)_p—SO_3M,$$

where $R^1$ is $C_8$ to $C_{20}$ alkyl, preferably $C_{10}$ to $C_{18}$ and more preferably $C_{12}$ to $C_{15}$; p is 1 to 8, preferably 2 to 6, and more preferably 2 to 4; and M is an alkali metal, such as sodium and potassium, or an ammonium cation. The sodium and potassium salts are preferred.

A preferred higher alkyl poly ethoxylated sulfate is the sodium salt of a triethoxy $C_{12}$ to $C_{15}$ alcohol sulfate having the formula:

$$C_{12\text{-}15}—O—(CH_2CH_2O)_3—SO_3Na$$

Examples of suitable alkyl ethoxy sulfates that can be used in accordance with the present invention are $C_{12\text{-}15}$ normal or primary alkyl triethoxy sulfate, sodium salt; n-decyl diethoxy sulfate, sodium salt; $C_{12}$ primary alkyl diethoxy sulfate, ammonium salt; $C_{12}$ primary alkyl triethoxy sulfate, sodium salt; $C_{15}$ primary alkyl tetraethoxy sulfate, sodium salt; mixed $C_{14\text{-}15}$ normal primary alkyl mixed tri- and tetraethoxy sulfate, sodium salt; stearyl pentaethoxy sulfate, sodium salt; and mixed $C_{10\text{-}18}$ normal primary alkyl triethoxy sulfate, potassium salt.

The normal alkyl ethoxy sulfates are readily biodegradable and are preferred. The alkyl poly-lower alkoxy sulfates can be used in mixtures with each other and/or in mixtures with the above discussed higher alkyl benzene, sulfonates, or alkyl sulfates.

The detergent compositions of the present invention are laundry compositions and consequently, preferably include at least 2% of an anionic surfactant, to provide dtergency and foaming. Generally, the amount of the anionic surfactant is in the range of from 5% to 80%, preferably from 5% to 30% to accommodate the co-inclusion of nonionic surfactants, more preferably from 7% to 20% and, optimally, from 8% to 18%. It should be noted that an excess of anionic surfactant maybe detrimental to the stability of an emulsion in the inventive compositions. The minimal anionic surfactant, however, is required to provide foaming in laundry detergent applications.

Nonionic Surfactant

As is well known, the nonionic surfactants are characterized by the presence of a hydrophobic group and an organic hydrophilic group and are typically produced by the condensation of an organic aliphatic or alkyl aromatic hydrophobic compound with ethylene oxide (hydrophilic in nature). Typical suitable nonionic surfactants are those disclosed in U.S. Pat. Nos. 4,316,812 and 3,630,929, incorporated by reference herein.

Usually, the nonionic surfactants are polyalkoxylated lipophiles wherein the desired hydrophile-lipophile balance is obtained from addition of a hydrophilic poly-lower alkoxy group to a lipophilic moiety. A preferred class of nonionic detergent is the alkoxylated alkanols wherein the alkanol is of 9 to 20 carbon atoms and wherein the number of moles of alkylene oxide (of 2 or 3 carbon atoms) is from 3 to 20. Of such materials it is preferred to employ those wherein the alkanol is a fatty alcohol of 9 to 11 or 12 to 15 carbon atoms and which contain from 5 to 8 or 5 to 9 alkoxy groups per mole. Also preferred is paraffin-based alcohol (e.g. nonionics from Huntsman or Sassol).

Exemplary of such compounds are those wherein the alkanol is of 10 to 15 carbon atoms and which contain about 3 to 12 ethylene oxide groups per mole, e.g. Neodol® 25-9 and Neodol® 23-6.5, which products are made by Shell Chemical Company, Inc. The former is a condensation product of a mixture of higher fatty alcohols averaging about 12 to 15 carbon atoms, with about 9 moles of ethylene oxide and the latter is a corresponding mixture wherein the carbon atoms content of the higher fatty alcohol is 12 to 13 and the number of ethylene oxide groups present averages about 6.5. The higher alcohols are primary alkanols.

Another subclass of alkoxylated surfactants which can be used contain a precise alkyl chain length rather than an alkyl chain distribution of the alkoxylated surfactants described above. Typically, these are referred to as narrow range alkoxylates. Examples of these include the Neodol-1® series of surfactants manufactured by Shell Chemical Company.

Other useful nonionics are represented by the commercially well known class of nonionics sold under the trademark Plurafac® by BASF. The Plurafacs® are the reaction products of a higher linear alcohol and a mixture of ethylene and propylene oxides, containing a mixed chain of ethylene oxide and propylene oxide, terminated by a hydroxyl group. Examples include $C_{13}$–$C_{15}$ fatty alcohol condensed with 6 moles ethylene oxide and 3 moles propylene oxide, $C_{13}$–$C_{15}$ fatty alcohol condensed with 7 moles propylene oxide and 4 moles ethylene oxide, $C_{13}$–$C_{15}$ fatty alcohol condensed with 5 moles propylene oxide and 10 moles ethylene oxide or mixtures of any of the above.

Another group of liquid nonionics are commercially available from Shell Chemical Company, Inc. under the Dobanol® or Neodol® trademark: Dobanol® 91-5 is an ethoxylated $C_9$–$C_{11}$ fatty alcohol with an average of 5 moles ethylene oxide and Dobanol® 25-7 is an ethoxylated $C_{12}$–$C_{15}$ fatty alcohol with an average of 7 moles ethylene oxide per mole of fatty alcohol.

In the compositions of this invention, preferred nonionic surfactants include the $C_{12}$–$C_{15}$ primary fatty alcohols or alyl phenols with relatively narrow contents of ethylene oxide in the range of from about 6 to 9 moles, and the $C_9$ to $C_{11}$ fatty alcohols ethoxylated with about 5–6 moles ethylene oxide.

Another class of nonionic surfactants which can be used in accordance with this invention are glycoside surfactants. Glycoside surfactants suitable for use in accordance with the present invention include those of the formula:

$$RO—(R^1O)_y—(Z)_x$$

wherein R is a monovalent organic radical containing from about 6 to about 30 (preferably from about 8 to about 18) carbon atoms; $R^1$ is a divalent hydrocarbon radical containing from about 2 to 4 carbons atoms; O is an oxygen atom; y is a number which can have an average value of from 0 to about 12 but which is most preferably zero; Z is a moiety derived from a reducing saccharide containing 5 or 6 carbon atoms; and x is a number having an average value of from 1 to about 10 (preferably from about 1½ to about 10).

A particularly preferred group of glycoside surfactants for use in the practice of this invention includes those of the formula above in which R is a monovalent organic radical (linear or branched) containing from about 6 to about 18 (especially from about 8 to about 18) carbon atoms; y is zero; z is glucose or a moiety derived therefrom; x is a number having an average value of from 1 to about 4 (preferably from about 1½ to 4). Nonionic surfactants which may be used include polyhydroxy amides as discussed in U.S. Pat. No. 5,312,954 to Letton et al. and aldobionamides such as disclosed in U.S. Pat. No. 5,389,279 to Au et al., both of which are hereby incorporated by reference into the subject application.

Generally, nonionics would comprise 0–70% by wt., preferably 5 to 50%, more preferably 5 to 25% by wt. of the composition.

Mixtures of two or more of the nonionic surfactants can be used.

Cationic Surfactants

Many cationic surfactants are known in the art, and almost any cationic surfactant having at least one long chain alkyl group of about 10 to 24 carbon atoms is suitable in the present invention. Such compounds are described in "Cationic Surfactants", Jungermann, 1970, incorporated by reference.

Specific cationic surfactants which can be used as surfactants in the subject invention are described in detail in U.S. Pat. No. 4,497,718, hereby incorporated by reference.

As with the nonionic and anionic surfactants, the compositions of the invention may use cationic surfactants alone or in combination with any of the other surfactants known in the art. Of course, the compositions may contain no cationic surfactants at all.

Amphoteric Surfactants

Amphoteric synthetic surfactants can be broadly described as derivatives of aliphatic or aliphatic derivatives of heterocyclic secondary and tertiary amines in which the aliphatic radical may be straight chain or branched and wherein one of the aliphatic substituents contains from about 8 to 18 carbon atoms and at least one contains an anionic water-soluble group, e.g. carboxylate, sulfonate, sulfate. Examples of compounds falling within this definition are sodium 3-(dodecylamino)propionate, sodium 3-(dodecylamino)propane-1-sulfonate, sodium 2-(dodecylamino)ethyl sulfate, sodium 2-(dimethylamino) octadecanoate, disodium 3-(N-carboxymethyldodecylamino)propane 1-sulfonate, disodium octadecyl-imminodiacetate, sodium 1-carboxymethyl-2-undecylimidazole, and sodium N,N-bis(2-hydroxyethyl)-2-sulfato-3-dodecoxypropylamine. Sodium 3-(dodecylamino)propane-1-sulfonate is preferred.

Zwitterionic surfactants can be broadly described as derivatives of secondary and tertiary amines, derivatives of heterocyclic secondary and tertiary amines, or derivatives of quaternary ammonium, quaternary phosphonium or tertiary sulfonium compounds. The cationic atom in the quaternary compound can be part of a heterocyclic ring. In all of these compounds there is at least one aliphatic group, straight chain or branched, containing from about 3 to 18 carbon atoms and at least one aliphatic substituent containing an anionic water-solubilizing group, e.g., carboxy, sulfonate, sulfate, phosphate, or phosphonate.

Specific examples of zwitterionic surfactants which may be used are set forth in U.S. Pat. No. 4,062,647, hereby incorporated by reference.

The total amount of surfactant used may vary from 5 to 80%, preferably 10 to 50%.

As noted, the preferred surfactant systems of the invention are mixtures of anionic and nonionic surfactants.

Particularly preferred systems include, for example, mixtures of linear alkyl aryl sulfonates (LAS) and alkoxylated (e.g., ethoxylated) sulfates (AES) with alkoxylated nonionics for example in the ratio of 1:2:1.

Preferably, the nonionic should comprise, as a percentage of an anionic/nonionic system, at least 20%, more preferably at least 25%, up to about 75% of the total surfactant system. A particularly preferred surfactant system comprises anionic:nonionic in a ratio of 3:1 to 1:3.

Emulsifier

Although not wishing to be bound by this theory, applicants believe that the emulsifier employed in the present invention enhances the interaction of surfactants in the interfacial layer and increases the packing efficiency of surfactant in the emulsion droplets. This leads to the increase in the strength of the interfacial film at the interface of oil and water. The effect is to retard the flocculation and coalescence, and to increase the stability of the emulsion. Inclusion of the low HLB emulsifier is particularly critical in the presence of an anionic surfactant.

Emulsifiers suitable for use in the present invention have an HLB (hydrophilic-lipophilic balance) value below 8.5. Suitable emulsifiers may be silicone-based or silicone-free, polyoxyalkylene ethers of fatty alcohols, polyethylene glycol ether of glucose, sugar esters, sugar ester ethoxylates, polyethylene glycol ethers of sorbitol, glycerol ethoxylated fatty acid ester, dimethicone copolyol, alkyl dimethicone copolyol, acetyldimethicone copolyol, dialkyl sulfosuccinates, dialkyl phosphate, alkyl polyoxyethoxylates, sorbitan nonionic, oil-soluble-silicone surfactants, ethylene oxide/propylene oxide block polymers, dialkyl quaternary ammonium, and mixtures thereof. Preferred surfactants are PEG 30 dipolyhydroxyl stearate (Arlacel® P135), Span® 80 (sorbitan monostearate), Brij® 72 (polyoxyethylene(2) stearyl ether).

The precise amount of the emulsifier required to maintain an emulsion emulsion/isotropic two layer product stability depends on the nature and level of other ingredients, such as detergent surfactants, oil, solvent, and electrolytes. A typical level is from 0.1% to 10%, preferably from 0.1 to 5%, most preferably to optimize the compositions at the commerically useful surfactant levels, in an amount of from 0.1 to 3%.

Preferred laundry detergent compositions according to the invention include co-surfactants, to strengthen the stability of the emulsion. Preferred co-surfactants are selected from the group consisting of $C_{10}$ to $C_{22}$ fatty alcohols, and fatty acid with pH of the formulation is less than 7. The preferred co-surfactants are selected from is $C_{10}$ to $C_{22}$ fatty alcohols, in particular $C_{14}$ to $C_{18}$ alcohol, and, especially, cetyl alcohol due to commercial availability at economic cost, low odor profile and stability.

The amount of the co-surfactant is generally in the range of from 0.0 to 5%, preferably from 0.1 to 2%, and, most preferably, in order to optimize the cost of the composition and the stability of the emulsion from 0.1 to 1%.

Oil

Natural or synthetic oil or mixtures thereof may be employed. The oil may be a hydrocarbon oil and/or silicone oil. Generally, the hydrocarbon oil may be a paraffinic oil, a naphthenic oil, natural mineral oil or the like. Examples include but are not limited to mineral oil, castor oil, vegetable oil, corn oil, peanut oil, jojoba oil, 2-ethylhexyl oxystearate (and other alkyl oxystearates), acetylated lanolin alcohol, alkyl palmitates such as isopropyl palmitate, 2-ethylhexyl palmitate, glycerol triacetates, disopropyl adipate, dioctyl adipate (and other alkyl adipates), isopropyl myristate, $C_{12}$ to $C_{15}$ alcohol benzoates, and the like.

Silicone oil: silicone oil, non-volatile silicone compounds includes a polyalkyl siloxane, a polyaryl siloxane or a poly alkylaryl siloxane, and mxitures thereof. The preferred non-volatile silicone is polydimethylsilioxane compound; $(CH_3)_3$ SiO—$[Si(CH_3)_2O]_n$—$Si(CH_3)_3$. Such as DC 200, Fluid 50, Dow corning; silsoft® 034, silsoft® ME-5 silisoft® 148, L-45 of OSI of Crompton; Silsoft® 034-capryly methicone, silsoft® 148-cyclomethicone dimethiconol copolyol, silisoft® 148-cyclomethicone dimethiconol, L-45-dimethicone.

Most preferably, the oil is mineral oil, because it is both economic and most compatible with surfactant systems described above.

The oil is employed in the present compositions in an amount sufficient to provide a visible emulsion layer. Typically, the amount of oil is in the range of from 5 to 50%, preferably from 6 to 35%, most preferably from 7 to 25% and, optimally, from 8 to 20%. The oil may contain some solid e.g. wax or other solid ingredients, and may still be suitable for using the present composition as long as it is pourable at room temperature of 20–25° C.

Electrolyte

Electrolyte included into the inventive compositions is selected from the group of organic electrolytes (i.e., organic cation), inorganic electrolytes (i.e. inorganic cation) and mixtures thereof. Electrolyte may be pre-formed or formed in situ.

Suitable anions include but are not limited to citrate, sulphate, nitrate, fluoride, chloride, bromide, iodide, acetate, tartrate, ammonium tartrate, benzenesulphonate, benzoate, bicarbonate, carbonate, bisulphate, bisulphite, sulphate, sulphite, borate, borotartrate, bromate, butyrate, chlorate, camphorate, chlorite, cinnamate, disilicate, dithionate, ethylsulphate, ferricyanide, ferrocyanide, fluorosilicate, formate, glycerophosphate, hydrogenphosphate, hydroxostannate, hypochlorite, hyponitrite, hypophosphite, iodate, isobutyrate, lactate, laurate, metaborate, metasilicate, methionate, methylsulphate, nitrite, oleate, orthophosphate, orthophosphite, orthosilicate, oxalate, perborate, perchlorate, phosphate, polyfluoride, polychloride, polyiodide, polybromide, polysulphide, polysulphate, polysulphite, salicylate, silicate, sorbate, stannate, stearate, succinate or valerate, dichromate, chromate, nitrate, throyonate, permanganate, bromide, chloride, fluoride, gluconate, phenolsulfate, selenate.

"Organic electrolyte" as used herein means an electrolyte containing an organic cation. "Organic cation," in turn, means a non-metal, positively charged ionic entity. Suitable organic cations include but are not limited to ammonium, ammonium hydroxide, amines, more preferably alkanolamines (e.g., monoethanolamine, diethanolamine, triethanolamine, isopropylamine). Preferred organic electrolytes are selected from the group consisting of monoethanolamine, triethanolamine, and ammonium oxide salts of citrate, carbonate, bicarbonate, borate and sulfate. Monoethanolamine salt is the most effective. Monoethanolamine citrate, monoethanolamine carbonate and monoethanolamine borate are the most preferred, due to their ability to also function as builders and/or buffering agents in the detergent composition.

"Inorganic electrolyte" as used herein means an electrolyte containing an alkali or alkaline earth metal cation. Suitable inorganic electrolytes include but are not limited to sodium, potassium, lithium, magnesium, and calcium salts. Preferred electrolytes are selected from the group consisting of sodium and potassium salts of citrate, carbonate, phosphate, bicarbonate, borate and sulfate. Sodium salt is the most cost-effective. Sodium citrate, sodium carbonate and sodium borate are the most preferred, due to their ability to also function as builders and/or buffering agents in the detergent composition.

The liquid detergent composition of the invention preferably includes from 0.5 to 30%, more preferably from 1 to 10%, most preferably from 1 to 15%, and optimally from 6 to 12% of the electrolyte, in order to attain a stable two-layered composition, at optimum cost. The precise concentration of electrolyte to create a two-layered composition comprising a stable emulsion layer depends on the surfactant concentration, the water amount and the identity of the electrolyte. Too low concentration of the electrolyte results in a non separation or insufficent separation of the layers; too high concentration of the electrolytes results in an unstable emulsion or the inversion of the emulsion to continuous oil phase. The concentration needed may be predicted by calculating the ionic strength indicator of the electrolyte at a particular concentration. It has been found as part of the present invention that the preferred electrolytes and preferred concentrations are those that have a calculated ionic strength indicator of 0.55 to 6.7 preferably 0.6 to 6.0, most preferably 0.6 to 5.0.

Ionic strength indicator represents interactions of ions with water molecules and other ions in the solution. Ionic strength indicator may be calculated as follows:

$$I=\tfrac{1}{2}\Sigma z_i^2 m_i$$

Σ=a sum for i number of ions

I=ionic strength z=valence factor $m_i$=mole concentration of electrolytes, calculated from the amount of electrolytes and water only excluding detersive surfactants, emulsifers, oil, hydrotropes, and any solvents such as proylene glycol.

Inorganic salt (citrate, sulfate, acetate, chloride, carbonate, silicate, borate) preferred due because they are highly soluble and inexpensive; and some salts also serve as builders to control the hardness to assist in removal of stains (particulates), for example citrates, (which are also available from renewable resources and their biodegradable).

Particularly preferred is citrate, due to its additional functionality as a builder and its pleasant odour. The amount of citrate (calculated so the water of hydration is included) is typically from 2 to 19%, preferably from 2 to 10%.

It should be noted that the excessive amount or excessive ionic strength results in emulsion de-stabilization or inversion.

Layers

The ingredients present in the inventive compositions typically result in the formation of at least two layers, with one of the layers being an emulsion with a continuous aqueous phase. The continuous aqueous phase in the emulsions minimises the sticking of the oil to the container. The emulsion layer also provides a pleasing appearance and visual signal to the consumer of the presence of a benefit ingredient and/or a milder product.

The emulsion layer typically has milky or white appearance. The emulsion layer is typically a top layer, due to the lower density of oil compared to water.

Preferably the bottom layer is an isotropic transparent composition, preferably including a colorant. "Transparent" as used herein includes both transparent and translucent and means that an ingredient, or a mixture, or a phase, or a composition, or a package according to the invention preferably has a transmittance of more than 25%, more preferably more than 30%, most preferably more than 40%, optimally more than 50% in the visible part of the spectrum (approx. 410–800 nm). Alternatively, absorbency may be measured as less than 0.6 (approximately equivalent to 25% transmitting) or by having transmittance greater than 25% wherein % transmittance equals: $1/10^{absorbancy} \times 100\%$. For purposes of the invention, as long as one wavelength in the visible light range has greater than 25% transmittance, it is considered to be transparent/translucent.

When shaken, the discontinuous phase within the composition may be dispersed homogenerously. Yet, they separate into visible layers, upon standing for at most 24 hours at 20–25° C.

The volume ratio of the two layers in the final composition is generally in the range of from 1:9 to 9:1, preferably from 8:2 to 2:8, more preferably at least from 7:3 to 3:7, most preferably from 6:4 to 4:6, in order to provide the most pleasing appearance and optimum cleaning benefits.

It should be noted that in the final composition, the compositions of the resultant layers do not necessarily correspond with the compositions of the respective layers prior to their being combined into a single composition (if composition is formed by pre-mixing). This is because of reaction between ingredients, in particular the acidic ingredients and the basic ingredients (e.g., sodium hydroxide) and also, because of possible migration of material between the two layers, or emulsification of some of the layers within each other.

Optional Ingredients

Hydrotrope

A particularly preferred optional ingredient is a hydrotrope, which prevents liquid crystal formation. The addition of the hydrotrope thus aids the clarity/transparency of the composition. The hydrotrope is typically included in the surfactant layer. Suitable hydrotropes include but are not limited to propylene glycol, ethanol, urea, salts of benzene sulphonate, toluene sulphonate, xylene sulphonate or cumene sulphonate. Suitable salts include but are not limited to sodium, potassium, ammonium, monoethanolamine, triethanolamine. Preferably, the hydrotrope is selected from the group consisting of propylene glycol, xylene sulfonate, ethanol, and urea to provide optimum performance. The amount of the hydrotrope is generally in the range of from 0 to 30%, preferably from 0.5 to 30%, more preferably from 0.5 to 30%, most preferably from 1 to 15%.

Colorant

The colorant may be a dye or a pigment. Most preferably, a water-soluble dye (to prevent staining on clothes) is incorporated within a transparent, uncolored continuous phase.

Additional Builders

Certain zeolites or aluminosilicates can be used. One such aluminosilicate which is useful in the compositions of the invention is an amorphous water-insoluble hydrated compound of the formula $Na_x(AlO_2)_ySiO_2$, wherein x is a number from 1.0 to 1.2 and y is 1, said amorphous material being further characterized by a Mg++ exchange capacity of from about 50 mg eq. $CaCO_3$/g. and a particle diameter of from about 0.01 micron to about 5 microns. This ion exchange builder is more fully described in British Pat. No. 1,470,250.

A second water-insoluble synthetic aluminosilicate ion exchange material useful herein is crystalline in nature and has the formula $Na_z[(AlO_2)_y.(SiO_2)]xH_2O$, wherein z and y are integers of at least 6; the molar ratio of z to y is in the range from 1.0 to about 0.5, and x is an integer from about 15 to about 264; said aluminosilicate ion exchange material having a particle size diameter from about 0.1 micron to about 100 microns; a calcium ion exchange capacity on an anhydrous basis of at least about 200 milligrams equivalent of $CaCO_3$ hardness per gram; and a calcium exchange rate on an anhydrous basis of at least about 2 grains/gallon/minute/gram. These synthetic aluminosilicates are more fully described in British Patent No. 1,429,143.

The preferred laundry composition may further include one or more well-known laundry ingredients, anti-redeposition agents, fluorescent dyes, perfumes, soil-release polymers, colorant, enzymes, bleaches, bleach precursors, buffering agents, antifoam agents, UV-absorbers, etc.

Optical brighteners for cotton, polyamide and polyester fabrics can be used. Suitable optical brighteners include Tinopal, stilbene, triazole and benzidine sulfone compositions, especially sulfonated substituted triazinyl stilbene, sulfonated naphthotriazole stilbene, benzidene sulfone, etc., most preferred are stilbene and triazole combinations. A preferred brightener is Stilbene Brightener N4 which is a dimorpholine dianilino stilbene sulfonate.

Anti-foam agents, e.g. silicone compounds, such as Silicane L 7604, can also be added in small effective amounts.

Bactericides, e.g. tetrachlorosalicylanilide and hexachlorophene, fungicides, dyes, pigments (water dispersible), preservatives, e.g. formalin, ultraviolet absorbers, anti-yellowing agents, such as sodium carboxymethyl cellulose, pH modifiers and pH buffers, color safe bleaches, perfume and dyes and bluing agents such as Iragon Blue L2D, Detergent Blue 472/372 and ultramarine blue can be used.

Also, soil release polymers and cationic softening agents may be used.

The list of optional ingredients above is not intended to be exhaustive and other optional ingredients which may not be listed, but are well known in the art, may also be included in the composition.

The pH of the inventive compositions is generally in the range of from 2.5 to 12.5, preferably in the range of from 4 to 10, most preferably from 6 to 9, in order to attain optimum laundry cleaning.

Preferred Ingredients in the Emulsion Layer

The composition preferably includes in the emulsion layer:

(a) Oil-soluble ingredients, such as perfume, oily solvent such as fatty acid ester, cationic surfactant.

(b) Water-Insoluble or Low Water solubility or Water-Soluble or Sensitive Ingredients For Inclusion Into Emulsion Layer: enzymes, polymers, such as styrene/acrylate copolymers, sodium carboxy methyl cellulose, bleach.

Process of Making Composition

The composition may be prepared by either of the two methods described in the Example section below.

Container

Preferred containers are transparent/translucent bottles.

Transparent bottle materials with which this invention may be used include, but are not limited to: polypropylene (PP), polyethylene (PE), polycarbonate (PC), polyamides (PA) and/or polyethylene terephthalate (PETE), polyvinylchloride (PVC); and polystyrene (PS).

The container of the present invention may be of any form or size suitable for storing and packaging liquids for household use. For example, the container may have any size but usually the container will have a maximal capacity of 0.05 to 15 L, preferably, 0.1 to 5 L, more preferably from 0.2 to 2.5 L. Preferably, the container is suitable for easy handling. For example the container may have handle or a part with such dimensions to allow easy lifting or carrying the container with one hand. The container preferably has a means suitable for pouring the liquid detergent composition and means for reclosing the container. The pouring means may be of any size of form but, preferably will be wide enough for convenient dosing the liquid detergent composition. The closing means may be of any form or size but usually will be screwed or clicked on the container to close the container. The closing means may be cap which can be detached from the container. Alternatively, the cap can still be attached to the container, whether the container is open or closed. The closing means may also be incorporated in the container.

The following specific examples further illustrate the invention, but the invention is not limited thereto. The ingredients used for the Examples were as follows:

| Ingredients | Chemical name | HLB | supplier |
|---|---|---|---|
| Mineral oil | Hydrocarbon compounds | | Witco |
| Arlacel ® P135 | PEG-30 dipolyhydroxstearate | 5.5 | Uniqma |
| C16 alcohol | Cetyl alcohol | | Croda |
| Tween ®-40 | POE(20) sorbitan monopalmitate | 15.6 | Uniqema |
| Span ® 80 | Sorbitan monooleate | 4.3 | Uniqema |
| LAS acid | alkylbenzene sulfonic acid | | Stepan |
| Sodium LAS | Sodium alkylbenzenesulfonate | 37.0 | Prepared in situ |
| Sodium LES | Sodium ethoxylated alcohol sulfate (59.4%) | 40.0 | Stepan |
| Neodol ® 25-9 | $C_{12-25}H_{25-31}EO_9$ | 13.1 | Shell |
| Sodium xylene sulfonate | | | Stepan |

-continued

| Ingredients | Chemical name | HLB | supplier |
|---|---|---|---|
| PPG | Propylene glycol | | Eastman chemical |
| MEA | Monoethanolamine | | Dow chemical |
| ReWO ®-CQ-100 | Blend of nonionic and cationic surfactants (Proprietary product) | | Goldschidt Chemical |
| Brij ® 72 | Polyoxyethylene (2) stearyl ether | 4.9 | Uniqema |
| Witcamide ® 511 | Fatty alkanolamide | | Witco |
| Tergitol ® 15-S-20 | $C_{11-15}H_{23-31}EO_{20}$ (Secondary alcohol ethoxylate) | 16.4 | Union Carbide |
| Stearic acid | A mixture of octyldecanoic acid and hexyldecanoic acid at a ratio of 47/53 by weight of the composition | | Uniqema |
| MEA coconate | Monoethanolammonium coconate | >16 | Prepared in situ |

HLB and Application

| HLB range | Application |
|---|---|
| 3~6 | W/O emulsion |
| 7~9 | Wetting and Penetration |
| 8~15 | O/W emulsion |
| 13~15 | Detergents |
| 15~18 | Solubilization |

"Surfactants and Polymers in Aqueous Solution" by B. Jonsson, et al., John Wiley and Sons, 1998.

All percentages, parts, and ratios used herein are by weight unless otherwise specified. The following non-limiting examples illustrate the compositions of the present invention and methods of manufacture.

Stable emulsion/isotropic two layer liquid detergents were prepared by two methods.

Method 1: Two premixes were prepared first, and a high shear mixer was used to mix them to form an emulsion. This emulsion then separated into an emulsion/isotropic two-layer product upon standing for less than 24 hours. This emulsion/isotropic two-layer product was stable for at least 3 months.

Method 2: An emulsion made of an oil phase and an aqueous detergent phase was prepared first. Followed by mixing the emulsion with an electrolyte solution, an emulsion/isotropic liquid detergent was then formed upon standing for less than 24 hours. This emulsion/isotropic two-layer product was stable for at least 3 months.

EXAMPLE 1

Example 1 describes Method 1 of preparation of an emulsion/isotropic two-layer detergent. The Premix 1 and Premix 2 were made first separately by mixing the ingredients in the order listed in the formula. The two premixes were then mixed together and homogenized by use of a Clifford-Wood Homogenizer, model 1L-75.

| Ingredients | % |
|---|---|
| Premix 1 | |
| Mineral oil | 16.76 |
| Arlacel ® P135 | 1.28 |
| C16 alcohol | 0.50 |
| Premix 2 | |
| Water | 47.09 |
| Sodium citrate.2H2O | 8.24 |
| Monoethanolamine (MEA) | 0.17 |
| Coco acid | 0.59 |
| Sodium LAS | 4.54 |
| Sodium ethoxylated alcohol sulfate | 7.94 |
| Neodol ® 25-9 | 4.99 |
| PPG | 3.59 |
| Miscellaneous | q.s. |
| Total | 100.00 |

After neutralization, anionic surfactants account for 13.24% by weight of the composition. Total surfactant is 18.23% by weight of the composition. Sodium LAS and sodium LES have HLB values of 37, 40 respectively. MEA cocoate's HLB is more than 16. Arlacel® P135 has a HLB value of 5.5. C16 alcohol has a HLB less than 5.

Premix 1 was made by dissolving Arlacel P135 and cetyl alcohol in Mineral oil. This premix 1 was mixed and heated at 50° C. and formed a clear solution.

Premix 2 was prepared by adding each ingredient to water in the order shown in the above formula, and mixing them at a temperature of 45° C.~50° C. Mixing was continued at 45° C.~50° C. until the solution was clear and homogeneous.

Premix 1 was then added to premix 2 and mixed together at 45° C. It was noted that an emulsion was formed upon mixing the two premixes. The mixture was then homogenized by use of a Clifford-Wood Homogenizer model 1L-75 for 4~5 minutes at 45° C. This emulsion then separated into an emulsion/isotropic two-layer product upon standing for less than 24 hours. This emulsion/isotropic two-layer product was stable for at least 3 months.

EXAMPLE 2

| Ingredients | % |
|---|---|
| Premix 1 | |
| Mineral oil | 10.91 |
| Arlacel ® P135 | 0.94 |
| C16 alcohol | 0.18 |
| Premix 2 | |
| H2O | 42.51 |
| Sodium citrate.2H2O | 9.69 |
| NaOH (50%) | 2.35 |
| Sodium xylenesulfonate (30%) | 5.18 |
| LAS acid | 8.28 |
| Sodium ethoxylated alcohol sulfate | 8.34 |
| Neodol ® 25-9 | 8.34 |
| PPG | 3.10 |
| Miscellaneous | to |
| Total | 100.00 |

After neutralization, anionic surfactants account for 17.7% by weight of the composition. Total surfactant is 26.13% by weight of the composition. Sodium LAS and sodium LES have HLB values of 37, 40 respectively. Arlacel P135 has a HLB value of 5.5. C16 alcohol has a HLB less than 5.

Example 2 was prepared according to the procedure of Method 1. The emulsion/isotropic two-layer product prepared was stable for at least 3 months.

EXAMPLE 3

Example 3 illustrated Method 2 of preparation of an emulsion/isotropic two-layer detergent. Premix 1, Premix 2, and Premix 3 were made first, separately, by mixing the ingredients in the order listed in the formula. Premix 1 and Premix 2 were then mixed together and homogenized by use of a Clifford-Wood Homogenizer, model 1L-75 to give an emulsion. Followed by mixing the emulsion and Premix 3 with a regular over-head mixer, an emulsion/isotropic two-layer liquid detergent was then formed upon standing for less than 24 hours.

| Ingredients | % |
|---|---|
| Emulsion | |
| Premix 1 | |
| Mineral oil | 16.23 |
| Arlacel ® P135 | 0.66 |
| C16 alcohol | 0.10 |
| Tween ®-40 | 0.09 |
| Premix 2 | |
| Water | 16.52 |
| 50% NaOH | 0.69 |
| LAS acid | 2.44 |
| Sodium LES (59.39%) | 4.11 |
| Nonionic 25-9 | 2.44 |
| Miscellaneous | qs |
| Premix 3 | |
| Sodium Citrate.2H2O | 10.84 |
| Water | 43.37 |
| | 100.0 |

After neutralization, anionic surfactants account for 5.22% by weight of the composition. Total surfactant is 7.75% by weight of the composition. Sodium LAS and sodium LES have a HLB value of 37, 40 respectively. Tween® 40's HLB is 15.6. Arlacel® P135 has a HLB value of 5.5. C16 alcohol has a HLB less than 5.

Premix 1 was made by dissolving Arlacel P135, cetyl alcohol, and Tween-40 in Mineral oil. This premix 1 was mixed and heated at 50° C. and formed a clear solution.

Premix 2 was prepared by adding each ingredients to water following the given order shown in the above formula, and mixing them at a temperature of 45° C.~50° C. Mixing was continued at 45° C.~50° C. until the solution was clear and homogeneous.

Premix 1 was added to the premix 2 and mixed at 45° C. It was noted that an emulsion was formed upon mixing the two premixes. The mixture was then homogenized by use of Clifford-Wood Homogenizer model 1L-75 for 4~5 minutes at 45° C., and a stable laundry detergent emulsion was prepared.

Premix 3 was prepared by dissolving a certain amount of sodium citrate.$2H_2O$ in water.

A final product was prepared by mixing the above laundry detergent emulsion and Premix 3 with a regular over-head mixer to ensure giving a homogeneous dispersion. This dispersion then separated into an emulsion/isotropic two-layer product upon standing for less than 24 hours. This emulsion/isotropic two-layer product was stable for at least 3 months.

EXAMPLE 4

Example 4 was prepared by using Method 2.

| Ingredients | % |
|---|---|
| Premix 1 | |
| Mineral oil | 15.68 |
| Arlacel ® P135 | 0.61 |
| C16 alcohol | 0.24 |
| Stearic acid (ASP) | 0.60 |
| Brij ® 72 | 0.52 |
| Witcamide ® 511 | 0.94 |
| Propylene glycol | 1.75 |
| ReWO-CQ ®-100 | 0.72 |
| Premix 2 | |
| Water | 21.33 |
| Sodium citrate.2H2O | 0.55 |
| NaOH (50%) | 0.88 |
| LAS acid | 2.87 |
| Sodium ethoxylated alcohol sulfate | 1.90 |
| Neodol ® 25-9 | 1.90 |
| Sodium xylene sulonate (30%) | 1.17 |
| Miscellaneous | q.s. |
| Premix 3 | 0.00 |
| Sodium Citrate.2H2O | 9.79 |
| water | 39.16 |
| Total | 100.00 |

After neutralization, anionic surfactants account for 5.77% by weight of the composition. The total surfactant is 9.37% by weight of the composition. Sodium LAS and sodium LES have HLB values of 37, 40 respectively. Stearic soap's HLB is more than 15. ReWO-CQ-100 has a HLB higher than 15. Arlacel® P135 has a HLB value of 5.5. C16 alcohol has a HLB less than 5. Brij® has a HLB of 4.9.

The resulting emulsion/isotropic two-layer product prepared was stable for at least 3 months.

EXAMPLE 5

Example 5 describes the procedure of preparation of a W/O/W emulsion and isotropic two-layer product.

| Ingredients | % |
|---|---|
| Premix 1 (oil phase) | |
| Mineral oil | 17.51 |
| Arlacel ® P135 | 1.13 |
| C16 alcohol | 0.22 |
| Span ®-80 | 0.10 |

-continued

| Ingredients | % |
|---|---|
| Premix 2 (aqueous phase) | |
| Na Citrate.2H2O | 4.05 |
| water | 44.92 |
| Premix 3 (external aqueous phase) | |
| Water | 20.30 |
| 50% NaOH | 0.78 |
| Sodium xylene sulfonate | 1.60 |
| LAS acid | 2.73 |
| Sodium LES | 2.73 |
| Nonionic 25-9 | 4.60 |
| Miscellaneous | q.s. |
| | 100.00 |

After neutralization, anionic surfactants accounted for 5.80% by weight of the composition. Total surfactant was 10.45% by weight of the composition. Sodium LAS and sodium LES have HLB values of 37, 40 respectively. Arlacel® P135 has a HLB value of 5.5. C16 alcohol has a HLB less than 5. Span 80 has a HLB of 4.3.

A mixture of Arlacel® P135, $C_{16}$ alcohol, and Span® 80 was mixed and dissolved in Mineral oil at 50° C. This clear mineral oil solution, i.e., premix 1 was then held at 45° C.

A solution of sodium citrate was prepared by dissolving sodium citrate.$2H_2O$ in water, and this premix 2 was heated to 45° C. and held at this temperature.

Premix 3 was made at 40° C. by mixing the ingredients in the given order shown in the formula, and premix 3 so prepared stood so as to get rid of air bubbles.

The W/O emulsion was made by charging the aqueous Premix 2 into the oil phase Premix 1, followed by mixing at 45° C. with a Clifford-Wood homogenizer model 1L-75. This emulsion was a W/O type emulsion, it was confirmed by dispersing the emulsion into an non-polar solvent. The loading of aqueous phase was more than 70%.

The W/O emulsion was slowly added into premix 3 at 40° C. while keeping a gentle mixing with a regular over-head mixer. During this process, part of sodium citrate solution in the W/O emulsion migrated to the external aqueous phase, and this part of sodium citrate solution played a role in facilitating the formation of a two-layer separation. The final product, after the layers separated, usually within a 24 hour period, gave a W/O/W emulsion as the upper layer and a clear aqueous solution as the lower layer. The two layers were sharply separated. The W/O/W emulsion was confirmed by the microscopy. This emulsion/isotropic two-layer product was stable for at least 3 months.

EXAMPLE 6

Each sample listed in the Table was prepared by using Method 2. These samples were the emulsion part of the two-layer laundry detergent.

| Ingredients | 6A % | 6B % | 6C % | 6D % | 6E % | 6F % |
|---|---|---|---|---|---|---|
| Premix 1 | | | | | | |
| Mineral oil | 14.22 | 14.28 | 21.83 | 14.09 | 14.13 | 14.28 |
| Arlacel ® P135 | 0.00 | 1.09 | 0.73 | 1.08 | 1.08 | 0.00 |
| C16 alcohol | 0.00 | 0.00 | 0.15 | 0.00 | 0.00 | 0.00 |
| Stearic acid (ASP) | 0.00 | 0.00 | 0.00 | 0.39 | 0.00 | 0.00 |
| Tergitol ® 15-S-20 | 0.00 | 0.00 | 0.00 | 0.98 | 0.00 | 0.00 |
| Witcamide ® 511 | 0.00 | 0.00 | 0.00 | 0.00 | 0.65 | 0.00 |
| Tween ®-40 | | | | | | 1.09 |
| Premix 2 | | | | | | |
| Sodium ethoxylated alcohol sulfate | 8.85 | 8.89 | 8.12 | 8.76 | 8.79 | 8.89 |
| Sodium LAS | 5.06 | 5.08 | 4.64 | 5.01 | 5.02 | 5.08 |
| Neodol ® 25-9 | 5.56 | 5.59 | 5.10 | 5.51 | 5.53 | 5.59 |
| Monoethanolamine (MEA) | 0.19 | 0.19 | 0.18 | 0.19 | 0.19 | 0.19 |
| Sodium citrate.2H2O | 2.70 | 2.71 | 2.47 | 2.67 | 2.68 | 2.71 |
| Coco acid | 0.66 | 0.66 | 0.60 | 0.65 | 0.65 | 0.66 |
| PPG | 4.00 | 4.02 | 3.67 | 3.96 | 3.98 | 4.02 |
| Sorbitol | 2.74 | 2.75 | 2.51 | 2.71 | 2.72 | 2.75 |
| Borax, sodium pentahydrate | 1.80 | 1.80 | 1.65 | 1.78 | 1.78 | 1.80 |
| Alcosperse ® 725 | 0.25 | 0.25 | 0.23 | 0.25 | 0.25 | 0.25 |
| H2O | 53.57 | 52.69 | 48.13 | 51.97 | 52.34 | 52.69 |
| | 100.00 | 100.00 | 100.00 | 100.00 | 100.00 | 100.00 |
| Results | Not very stable | fair | fair | fair | good | Not very stable |

Samples in the above Table were prepared following Method 2 by varying the amount and the type of the emulsifiers. Each sample had over 5% of anionic surfactants by weight of the composition. Sodium LAS and sodium LES have a HLB value greater than 14. The results show that the emulsifier had an effect on stability of emulsion. Sample 6A without low HLB emulsifier resulted in a poor emulsion. Sample 6B having Arlacel® P135 (HLB=5.5) formed a stable emulsion. Sample 6C, having Arlacel® P135 (HLB=5.5) and cetyl alcohol (HLB<5) gave a stable emulsion. In sample 6D, a mixture of Arlacel® P135 (HLB=5.5), stearic acid, and Tergitol S-20 (HLB=16.4) gave a stable emulsion. Sample 6E using Arlacel® P135 (HLB=5.5) and Witcamide® 511 resulted in a stable emulsion. Sample 6F using Tween® −40 (HLB=15.6), an oil-in-water emulsifier, surprisingly did not give a very stable emulsion, pointing to the criticality of using a low HLB emulsifier.

EXAMPLE 7

Samples listed in the Table were prepared by Method 2 varying the amount of electrolyte.

| Ingredients | 7A % | 7B % | 7C % | 7D % | 7E % | 7F % | 7G % |
|---|---|---|---|---|---|---|---|
| Premix 1 | | | | | | | |
| Mineral oil | 16.66 | 16.66 | 16.66 | 16.66 | 16.66 | 16.66 | 16.66 |
| Arlacel ® P135 | 0.67 | 0.67 | 0.67 | 0.67 | 0.67 | 0.67 | 0.67 |
| C16 alcohol | 0.22 | 0.22 | 0.22 | 0.22 | 0.22 | 0.22 | 0.22 |
| Premix 2 | | | | | | | |
| Sodium ethoxylated alcohol sulfate | 3.41 | 3.41 | 3.41 | 3.41 | 3.41 | 3.41 | 3.41 |
| Sodium LAS | 1.95 | 1.95 | 1.95 | 1.95 | 1.95 | 1.95 | 1.95 |
| Neodol ® 25-9 | 10.14 | 10.14 | 10.14 | 10.14 | 10.14 | 10.14 | 10.14 |
| MEA | 0.07 | 0.07 | 0.07 | 0.07 | 0.07 | 0.07 | 0.07 |
| Sodium citrate.2H2O | 1.04 | 1.04 | 1.04 | 1.04 | 1.04 | 1.04 | 1.04 |
| Coco acid | 0.25 | 0.25 | 0.25 | 0.25 | 0.25 | 0.25 | 0.25 |
| PPG | 1.54 | 1.54 | 1.54 | 1.54 | 1.54 | 1.54 | 1.54 |
| Sorbitol | 1.06 | 1.06 | 1.06 | 1.06 | 1.06 | 1.06 | 1.06 |
| Borax, sodium pentahydrate | 0.69 | 0.69 | 0.69 | 0.69 | 0.69 | 0.69 | 0.69 |
| Alcosperse ® 725 | 0.10 | 0.10 | 0.10 | 0.10 | 0.10 | 0.10 | 0.10 |
| H2O | 12.22 | 12.22 | 12.22 | 12.22 | 12.22 | 12.22 | 12.22 |

-continued

| Ingredients | 7A % | 7B % | 7C % | 7D % | 7E % | 7F % | 7G % |
|---|---|---|---|---|---|---|---|
| Premix 3 | | | | | | | |
| Sodium Citrate.$2H_2O$ | 19.99 | 10.00 | 3.33 | 6.66 | 25.00 | 0.70 | 0.00 |
| $Na_2SO_4$ | | | | | | | 5.0 |
| water | 29.99 | 39.98 | 46.65 | 43.32 | 24.98 | 49.28 | 44.98 |
| Total | 100.00 | 100.00 | 100.00 | 100.00 | 100.00 | 100.00 | 100.00 |
| Results | | | | | | | |
| Rate of phase separation | <24 hr | <24 hr | <24 hr | <24 hr | <24 hr | >24 hr | <24 hr |
| Change in phase | Phase inversion and formed a fluffy layer at boundary | small | none | none | Phase inversion Immediately and the top layer sticked to the wall of bottle | | small |
| Ionic Strength indicator | 6.78 | 3.56 | 1.40 | 2.48 | 8.40 | 0.54 | 2.01 |

The anionic surfactants comprised over 5% by weight of the composition. Each sample had sodium LAS (HLB=37) and sodium LES (HLB=40), Arlacel P® 135 (HLB=5.5) and Cetyl alcohol (HLB<5).

From the results in the above Table, it is evident that the concentration of electrolyte affects the layer separation and the stability of the two-layer product. If the salt concentration was not high enough, the layer separation needed more than 24 hours. On the other hand, if the salt concentration was too high, the O/W emulsion inverted the phase to an W/O emulsion. An W/O emulsion increases the viscosity of the emulsion and sticks to the wall of the container, and is hard to be dispersed into aqueous solution. Therefore, there was a critical range of appropriate electrolyte concentration. Ionic strength indicator was generally used to clarify the effect of the electrolytes in an aqueous solution. Samples 7A and 7E had an ionic strength indicator value of 6.78, 8.40 respectively, and both of them had a phase inversion to an W/O emulsion. Sample 7B, 7C, 7D and 7G had an ionic strength indicator value between 2.00 and 3.56, and all of them separated into two layers in less than 24 hours, with the resulting emulsion/isotropic two layer products stable for at least 3 months. Sample 7F had an ionic strength indicator less than 0.6, and the layer separation needed more than 24 hours. In summary, when the ionic strength indicator was over 6.78, a phase inversion to W/O emulsion resulted, and when the ionic strength indicator was below 0.54, the phase separation needed more than 24 hours.

What is claimed is:

1. An aqueous liquid laundry detergent composition comprising (a) from about 5% to about 80%, by weight of the composition, of a detergent surfactant comprising an anionic surfactant;

(b) from about 0.1% to about 10%, by weight of the composition, of an emulsifier having an HLB value below about 8.5;

(c) from about 5% to about 50%, by weight of the composition, of an oil;

(d) an electrolyte in an amount to provide ionic strength indicator of from about 0.55 to about 6.7, wherein the composition upon standing for at most 24 hours at a temperature of 20–25° C. comprises at least two visible layers, wherein at least one layer is an emulsion and a second layer is an isotropic composition.

2. The composition of claim 1 wherein the emulsion is selected from the group consisting of an oil-in-water emulsion and water-in-oil-in water emulsions.

3. The composition of claim 1 wherein the second layer is a transparent composition.

4. The composition of claim 1 wherein the emulsion has an appearance of a milky layer.

5. The composition of claim 1 wherein the emulsion is a top layer of the composition.

6. The composition of claim 1 wherein the composition is packaged in a transparent container.

7. The composition of claim 1 further comprising in the emulsion layer an ingredient selected from the group consisting of an oil-soluble ingredient, a water-insoluble ingredient, a water-sensitive ingredient and mixtures thereof.

8. The composition of claim 1 further comprising from about 0.5 to about 30%, by weight of the composition, of a hydrotrope.

9. The composition of claim 1 wherein the composition further comprises a $C_{10}$ to $C_{22}$ fatty alcohol.

10. A liquid laundry detergent composition comprising:

(a) from about 5 to about 80%, by weight of the composition, of water;

(b) from about 5 to about 50%, by weight of the composition, of an oil;

(c) from about 0.1% to about 10% of an emulsifier having an HLB value below about 8.5;

(d) from about 2 to about 19% of citrate, wherein the composition upon standing for at most 24 hours at a temperature of 20–25° C. comprises at least two visible layers, wherein at least one layer is an emulsion and a second layer is an isotropic composition.

11. The composition of claim 10 wherein the emulsion is selected from the group consisting of an oil-in-water emulsion and water-in-oil-in water emulsions.

12. The composition of claim 10 wherein the second layer is a transparent composition.

13. The composition of claim 10 wherein the emulsion has an appearance of a milky layer.

14. The composition of claim 10 wherein the emulsion is a top layer of the composition.

15. The composition of claim 10 wherein the composition is packaged in a transparent container.

* * * * *